United States Patent [19]

Ogawa et al.

[11] Patent Number: 4,849,747

[45] Date of Patent: Jul. 18, 1989

[54] DISPLAY DATA TRANSFER CONTROL APPARATUS APPLICABLE FOR DISPLAY UNIT

[75] Inventors: Shinji Ogawa, Sagamihara; Haruhiko Tsuchiya, Yokohama; Tsutomu Araki, Sagamihara; Hiroshi Aoki, Yokohama; Hiroshi Yamamoto, Sagamihara, all of Japan

[73] Assignee: Panafacom Limited, Yamato, Japan

[21] Appl. No.: 928,012

[22] Filed: Nov. 7, 1986

Related U.S. Application Data

[63] Continuation-in-part of Ser. No. 939,771, Oct. 27, 1986.

[30] Foreign Application Priority Data

May 7, 1985 [JP] Japan ..... 60-096437

[51] Int. Cl.[4] ..... G09G 1/14

[52] U.S. Cl. ..... 340/735; 340/730; 340/731

[58] Field of Search ..... 340/790, 750, 703, 730, 340/731, 735; 364/200, 900, 188, 191

[56] References Cited

U.S. PATENT DOCUMENTS

| | | | |
|---|---|---|---|
| 3,868,673 | 2/1975 | Mau, Jr. et al. | 340/730 |
| 4,283,724 | 8/1981 | Edwards | 340/790 |
| 4,291,305 | 9/1981 | Kimura et al. | 340/734 |
| 4,405,830 | 9/1983 | Foster et al. | 340/703 |
| 4,439,761 | 3/1984 | Fleming et al. | 340/790 |
| 4,481,578 | 11/1984 | Hughes et al. | 364/200 |

*Primary Examiner*—John W. Caldwell, Sr.
*Assistant Examiner*—M. Fatahiyar
*Attorney, Agent, or Firm*—Staas & Halsey

[57] ABSTRACT

Disclosed is a display data transfer control apparatus in which a line control memory which can preset raster count data for modifying, in units of lines, an address of a main storage storing a character font to be displayed and character attribute data are provided, and a transfer line in the character font is determined for each line transfer in a DMA transfer sequence, so that, e.g., multi font control, character vertical elongation control, and ruled line vertical extension control, as well as processing character attributes such as an underline and overline, can be realized in the DMA transfer sequence.

11 Claims, 12 Drawing Sheets

CPU
10
DMA TRANSFER CONT-ROLLER
11
VRAM
12
CRT
13
LINE COUNTER MEMORY
14
RC#1
RC#2
RC#n
RC#N
LINE COUNTER
15
MEMORY ADDRESS REGISTER
17
16
RC LATCH CIRCUIT
18
ADDER
19
CHARACTER FONT STORAGE AREA
...012...AB
CDE.....XY
Z...
20
DATA LATCH CIRCUIT
21
ADDRESS MODIFICATION SECTION

14

| ATCL \ MODE | OVERLINE | | | UNDERLINE | | |
|---|---|---|---|---|---|---|
| | R | G | B | R | G | B |
| 1 | 1 | 0 | 1 | 0 | 0 | 0 |
| 2 | 0 | 0 | 0 | 0 | 0 | 0 |
| 3 | 0 | 0 | 0 | 0 | 0 | 0 |
| 4 | 0 | 0 | 0 | 0 | 0 | 0 |
| 5 | 0 | 0 | 0 | 0 | 0 | 0 |
| 6 | 0 | 0 | 0 | 0 | 0 | 0 |
| 7 | 0 | 0 | 0 | 0 | 0 | 0 |
| 8 | 0 | 0 | 0 | 1 | 0 | 1 |

DISPLAY DATA TRANSFER CONTROL APPARATUS APPLICABLE FOR DISPLAY UNIT

This is a continuation-in-part of U.S. application Ser. NO. 939,771 filed on Oct. 27, 1986.

BACKGROUND OF THE INVENTION

CROSS REFERENCE TO BE RELATED APPLICATION

This Application is related to U.S. Ser. Nos. 917,087,filed Sept. 17, 1987 and 928,005, filed Nov. 7, 1986.

1. Field of the Invention

The present invention relates to a display control apparatus employing a bit map method, and more particularly, to a display data transfer control apparatus applicable for a display unit, in which a so-called multi font control, a vertical elongation control of characters, an elongation control of vertical ruled lines, and the like can be performed in a DMA (Direct Memory Access) transfer sequence for transferring character font data from a main storage or pattern ROM (Read-Only Memory) to a video memory (VRAM; Video Random Access Memory). The present invention also relates to a display data transfer control apparatus in which a transfer data processing according to character attributes such as an underline or overline can be performed in addition to the above-mentioned functions in the DMA transfer sequence.

2. Description of the Related Art

A bit map method is known wherein a video memory (VRAM) corresponding to a display screen is provided as a means for displaying a character pattern, a graphic pattern, and the like, on a CRT display, and data on the display screen is temporarily stored in the VRAM and is then read out as a video signal to be displayed on the CRT display. The bit map method requires a 72-byte pattern expansion in order to display one character consisting of, e.g., 24 dots×24 dots, unlike a method in which the video signal is directly generated by a character generator in response to the character code. For this reason, a processing speed for expanding a character image in the VRAM is low.

Conventionally, to improve the processing speed, character font data is transferred from a main storage or a pattern ROM to the VRAM by a DMA transfer method. However, an allocation of the transferred character font data as screen data to a predetermined position on the VRAM, a character elongation control or ruled line connection control, and a character attributes processing for a character to be displayed are executed by a dedicated controller respectively.

With the conventional method, however, since the DMA transfer control is performed independently from the character elongation control, ruled line connection control, or a processing control of character attributes such as underline and overline the volume of hardware therefor increases, and it takes a great deal of time to expand a pattern in the VRAM.

SUMMARY OF THE INVENTION

It is an object of the present invention to provide a display data transfer control apparatus which performs character vertical elongation control, ruled line connection control; or character attribute processing during a DMA transfer sequence to reduce the volume of hardware and improve a processing speed.

In accordance with one aspect of the present invention, there is provided a display data transfer control apparatus comprising: a video memory for storing data of an image to be displayed on a display screen; a font memory for storing character font data in correspondence with each character; DMA transfer control means for performing a control in which the character font data read out from the font memory is transferred to the video memory by means of DMA in every unit of lines constituting character font; a line control memory for storing raster count data, corresponding to at least the number of lines to be transferred, for modifying an address of the font memory storing the character font data in units of lines; and address modification means for modifying an address of the character font data on the basis of the raster count data read out sequentially from the line control memory for each transfer of lines to generate a DMA transfer source address in the font memory; wherein the DMA transfer control means controls the reading out of the raster count data from the line control memory, and the generation of the DMA transfer source address by means of the address modification means, so as to transfer the character font read out from the font memory to the video memory.

In accordance with another aspect of the present invention, there is provided a display data transfer control apparatus comprising: a video memory for storing data of an image to be displayed on a display screen; a font memory for storing character font data in correspondence with each character; DMA transfer control means for performing a control in which the character font data read out from the font memory is transferred to the video memory by means of DMA in every unit of lines constituting a character font; a line control memory for storing raster count data and character attribute data, each corresponding to at least the number of lines to be transferred, the raster count data for modifying an address of the font memory storing the character font data in units of lines; address modification means for modifying an address of the character font data on the basis of the raster count data read out sequentially from the line control memory for each transfer of lines to generate a DMA transfer source address in the font memory; and character attribute control means for processing transfer data of the character font on the basis of the character attribute data read out sequentially from the line control memory for each transfer of lines; wherein the DMA transfer control means controls the reading out of the raster count data and the character attribute data from the line control memory, the generation of the DMA transfer source address by means of the address modification means, and the character attribute processing by means of the character attribute control means, so as to transfer the character font read out from the font memory while performing the character attribute processing to the video memory.

BRIEF DESCRIPTION OF THE DRAWINGS

Embodiments of the display data transfer control apparatus according to the present invention will be described hereinafter with reference to the accompanying drawings, in which.

DESCRIPTION OF THE PREFERRED EMBODIMENTS

For an easier understanding of the preferred embodiment of the present invention, a schematic arrangement of the present invention will now be described with reference to FIGS. 1 to 4.

Figure 1:
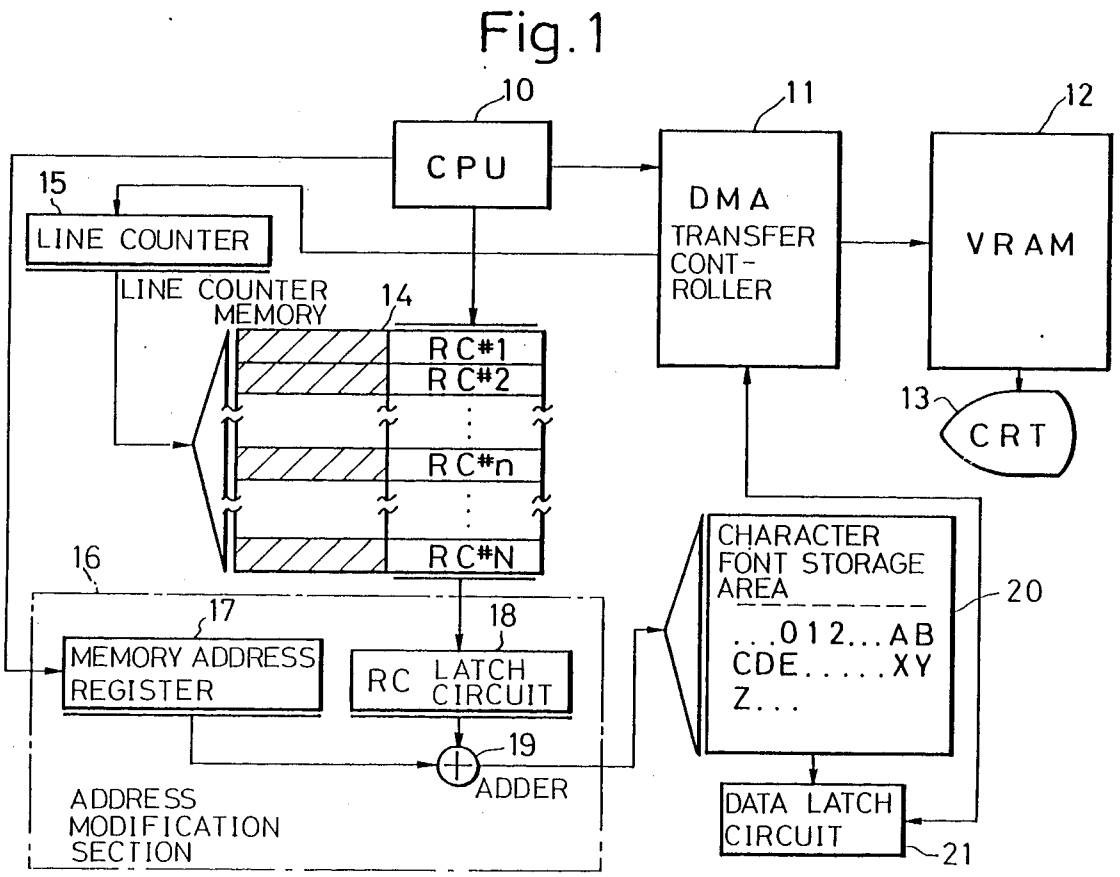
FIG. 1 is a block diagram showing a schematic arrangement of a display data transfer control apparatus as an embodiment according to the present invention.

FIG. 1 shows the schematic arrangement of an embodiment according to the present invention.

Referring to FIG. 1, a CPU (Central Processing Unit) 10 is a processor for sequentially fetching and executing instructions to display the processed result on a display. A DMA transfer controller 11 transfers a character font designated by the CPU 10 to a VRAM 12 by DMA control, and performs a control for expanding it on the VRAM 12 in a predetermined pattern. A display 13 converts screen data on the VRAM 12 into the video signal and displays the same on the display screen.

A line control memory 14 is a memory arranged in a predetermined area of, e.g., a main storage, and stores raster count (RC) data indicating which line portion of a character font is to be transferred for each transfer of lines of the character font. A line counter 15 is controlled by the DMA transfer controller 11, and supplies a read address to the line control memory 14.

An address modification section 16 is a circuit for generating an address of a line to be transferred in a character font storage area 20 by adding a character font origin address set in a memory address register (MAR) 17 and RC data read out to an RC latch circuit 18. The character font storage area 20 is a storage device, e.g., a main storage, a kanji ROM or the like, storing character font data corresponding to respective characters. A data latch circuit 21 is a circuit for latching data read out from the character font storage area 20.

When the CPU 10 cause the RC data to be preset in the line control memory 14, causes the origin address of a character font to be displayed to be stored in the MAR 17, and then enables the DMA transfer controller 11, the line counter 15 is updated by the DMA transfer controller 11, and the address of the character font storage area 20 is generated by the address modification section 16. Then, character font data corresponding to the generated address is DMA-transferred to the VRAM 12 through the data latch circuit 21.

Figure 2:
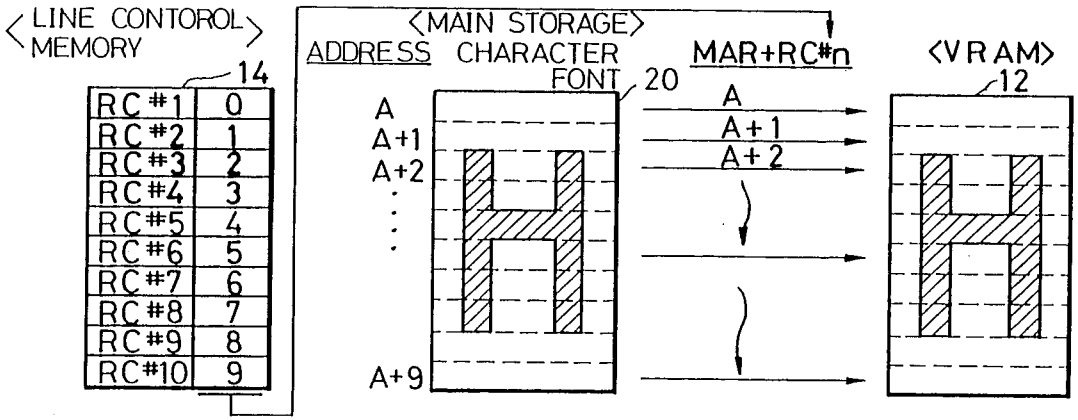
FIG. 2 is a block diagram for explaining a character font DMA transfer control operation.
Figure 3:
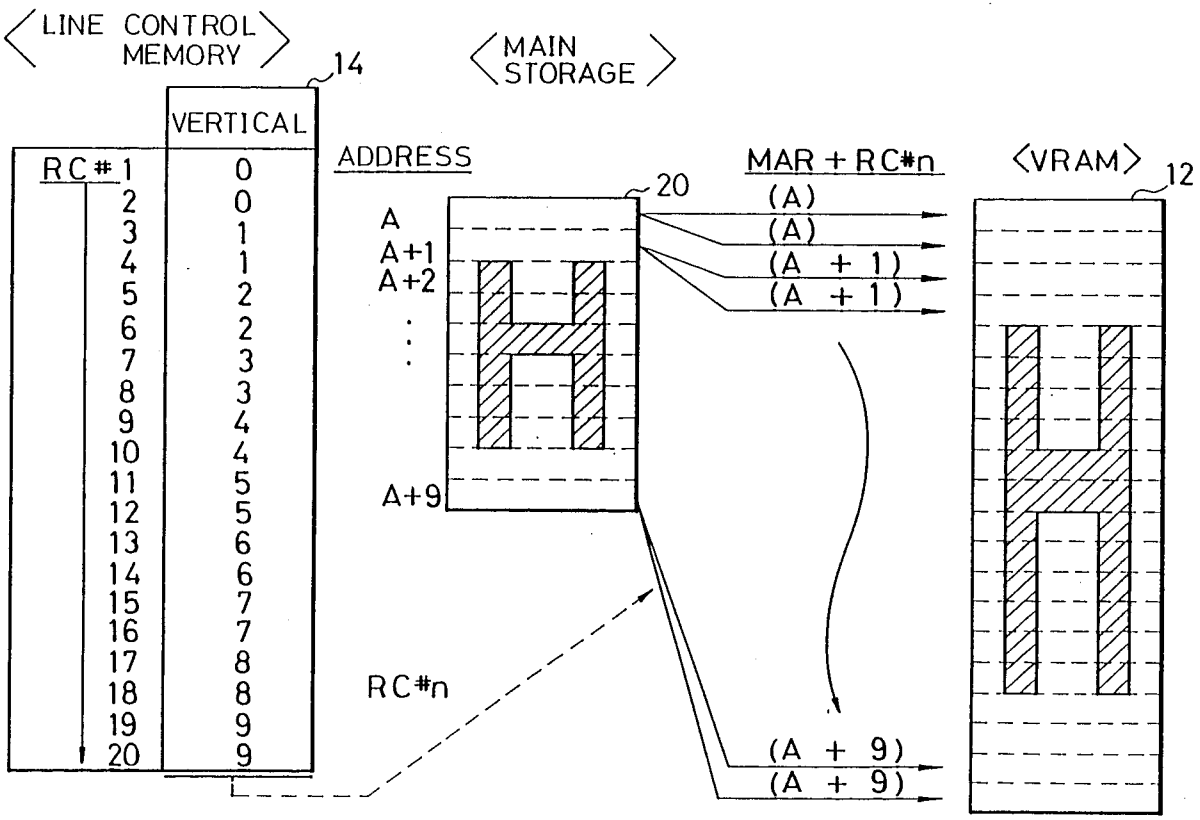
FIG. 3 is a view for explaining a vertical elongation DMA transfer control operation.
Figure 4:
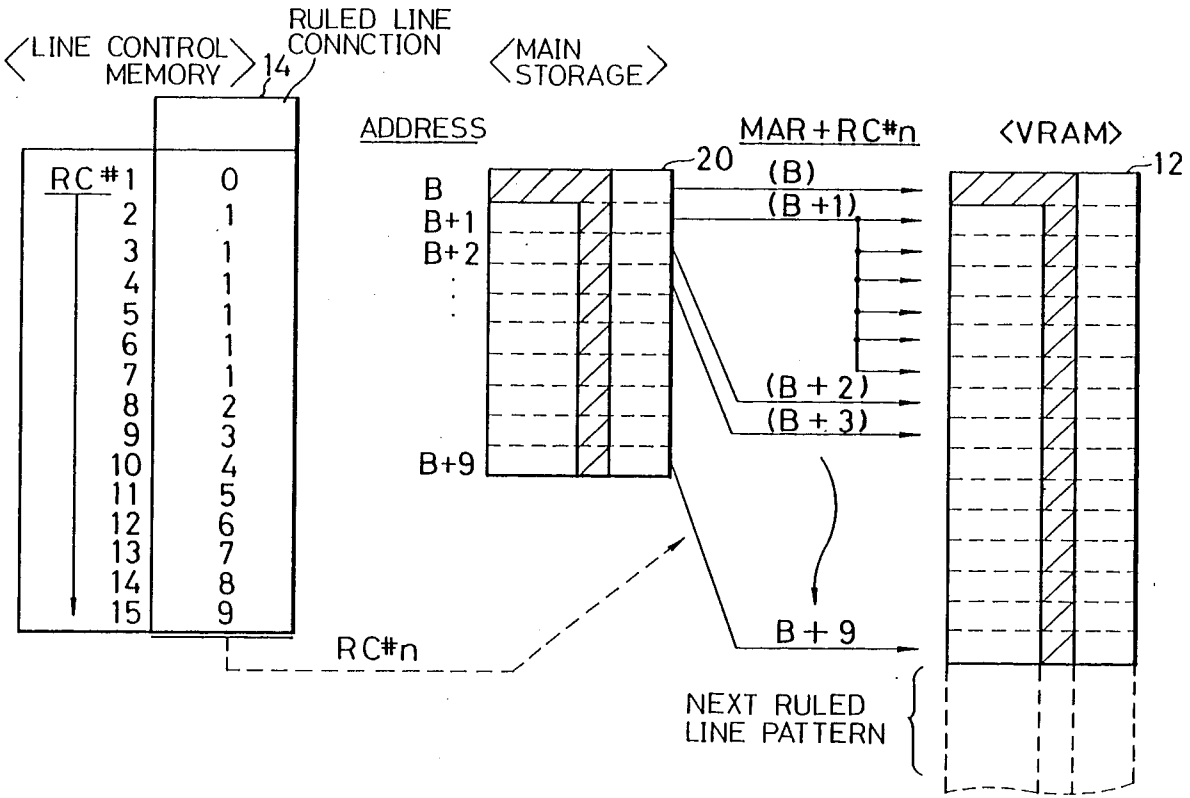
FIG. 4 is a view for explaining a ruled line connection control operation.

The basic operation of the apparatus shown in FIG. 1 will be described with reference to FIGS. 2 to 4. FIG. 2 is a view for explaining the character font DMA transfer control operation according to the present invention; FIG. 3 is a view for explaining the vertical elongation DMA transfer control operation; and FIG. 4 is a view for explaining the ruled line connection control operation.

For purposes of example, it is assumbed that a standard character font is constituted by 10 lines of dots. In character font transfer in a normal mode, as shown in FIG. 2, the CPU 10 shown in FIG. 1 presets values "0" to "9" as RC data (RC#1 to RC#10) to the line control memory 14. Assuming that the origin address of the character font in the main storage to be displayed is "A", character font transfer to and expansion on the VRAM 12 are performed as follows.

A line to be DMA-transferred first is a line at an address "A+0" obtained by adding the value "0" of the data RC#1 to the origin address A. A line to be DMA-transferred next is a line at an address "A+1" obtained by adding the value "1" of the data RC#2 to the origin address A. Similarly, the lines of the character font are read out in sequence for each line from the address positions obtained by adding the content of the MAR 17 and the values of the RC data, and are expanded on the VRAM 12. Note that data, such as destination addresses of data and the number of transfer lines, etc., is previously acknowledged to the DMA transfer controller 11 by the CPU 10.

When the CPU 10 displays a vertically elongated character, the RC data is set in the line control memory 14 in the state shown in FIG. 3. More specifically, in a vertical double elongation mode, each index value is set twice for each of the data RC#1 to RC#20, i.e., "001122 . . . 99". Thereby, lines of the character font at the addresses A, "A+1", . . . , "A+9" are transferred to the VRAM 12 twice, and a vertically elongated character is automatically generated.

When a ruled line used for such as a table is to be displayed, control for extending ruled line is required so as not to cause disconnection of the ruled line between character lines. Ruled line connection can be easily realized as follows.

As shown in FIG. 4, RC data having a plurality of identical index values obtained by repeating the value of a medium point of the ruled line, corresponding to a distance between character lines is preset in the line control memory 14. In the example of FIG. 4, all the data RC#2 to RC#7 are set to be "1", where five "1"s correspond to the distance between character lines. If a ruled line pattern to be displayed is preset after the address B in the main storage, a line at an address "B+1" is transferred six times, thereby automatically connecting the ruled line.

As described above, when the index values of character font lines to be transferred are appropriately set in the line control memory 14, various desired pattern expansion can be realized in the DMA transfer sequence.

Figure 5:
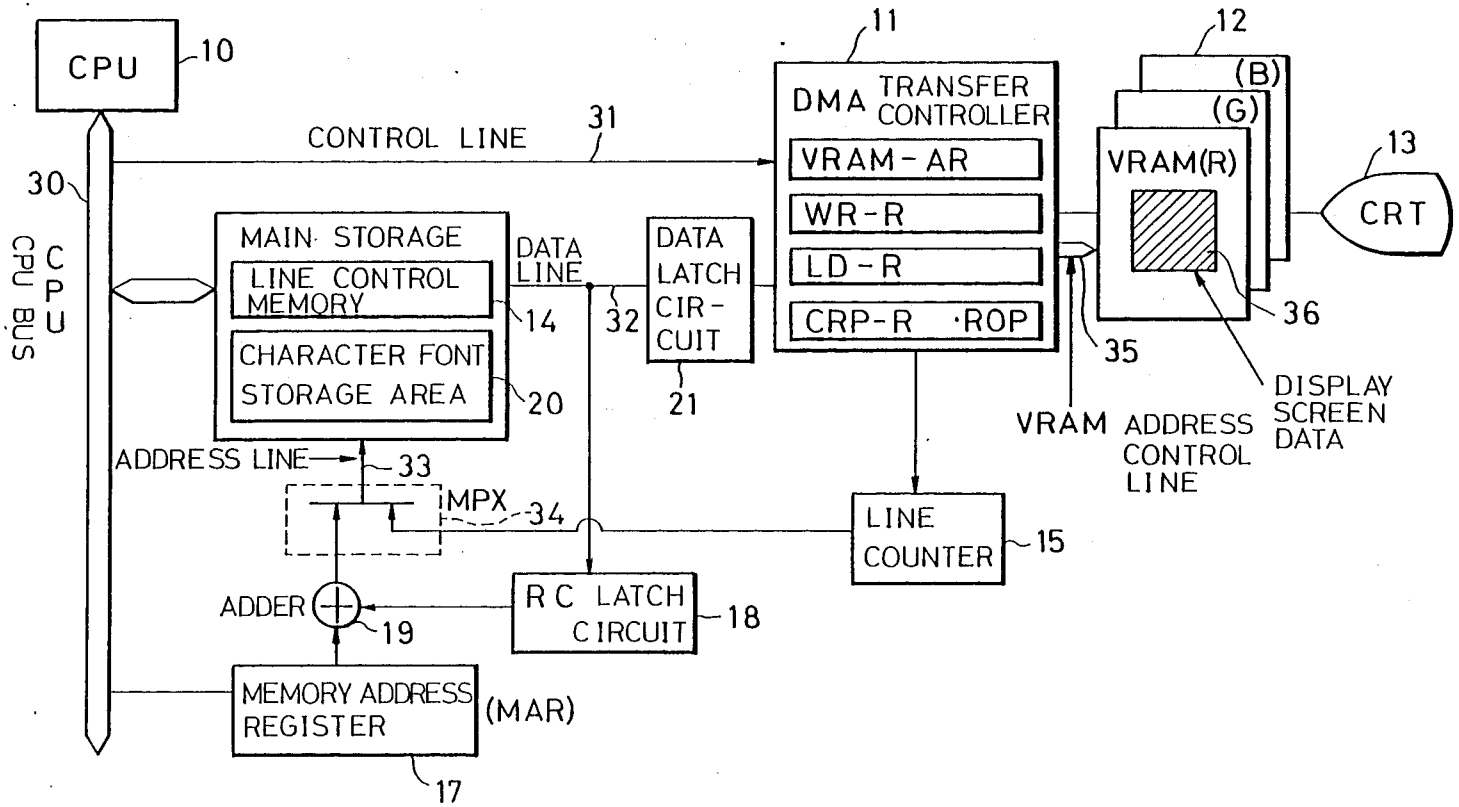
FIG. 5 is a more detailed block diagram of the embodiment shown in FIG. 1.
Figure 6:
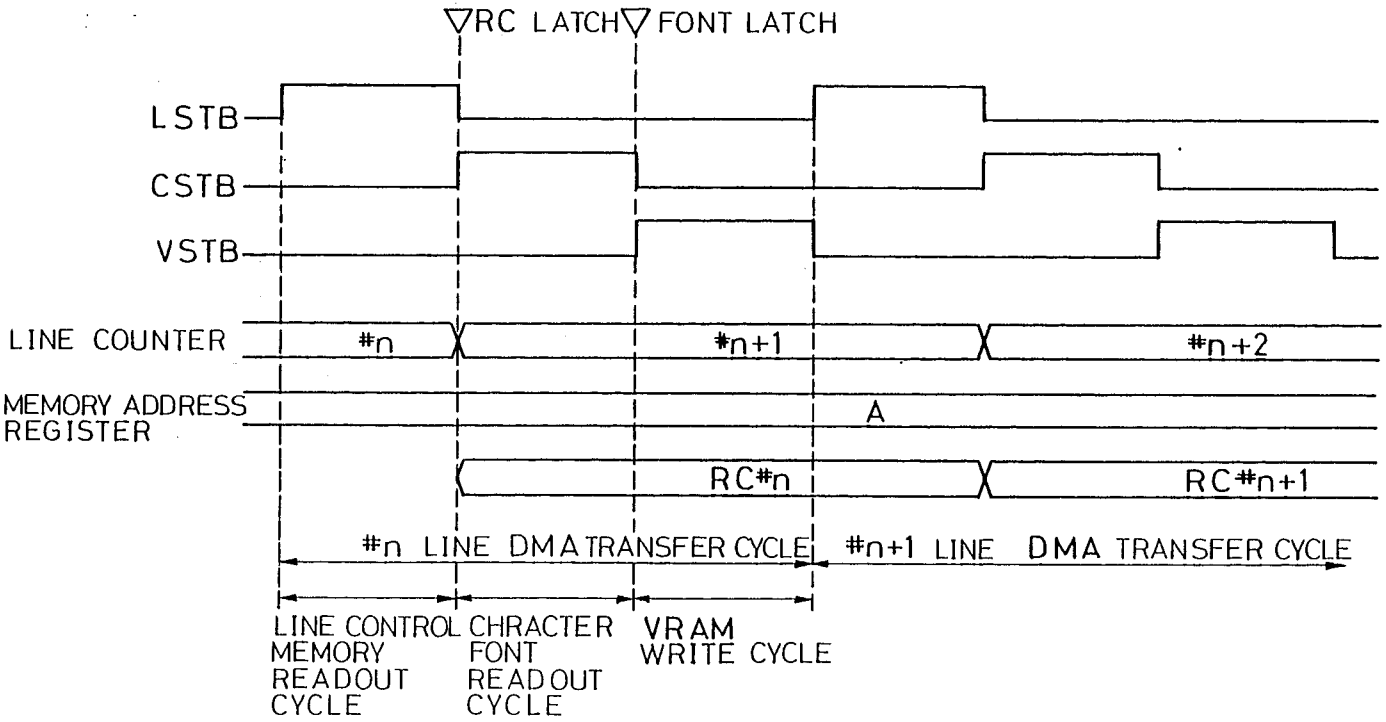
FIG. 6 is a timing chart of a character font DMA transfer sequence of the apparatus shown in FIG. 5.

The preferred embodiment of the present invention will be described in detail with reference to FIGS. 5 and 6. FIG. 5 is a more detailed block diagram showing the embodiment shown in FIG. 1, and FIG. 6 is a timing chart of a character font DMA transfer sequence of the apparatus shown in FIG. 5.

The same reference numerals in FIG. 5 denote the same parts as in FIG. 1. Reference numeral 30 denotes a CPU bus; 31, a control line; 32, a data line; 33, an address line; 34, an address multiplexer; 35, a VRAM address control line; and 36, display screen data.

In this embodiment, three, i.e., red (R), green (G), and blue (B), planes for color display are prepared as the VRAM 12. The DMA transfer controller 11 comprises a VRAM address register (VRAM-AR) indicating a destination address in the VRAM 12, a register (WD-R) for designating a line width of a character font, a register (LD-R) for designating the number of lines to be transferred, a register (CRD-R) for designating colors and a raster operation (ROP), and the like.

The line width can be designated as 4-bit multiples. The number of lines corresponds to the number of RC data set in the line control memory 14. The CPU 10 can voluntarily designate the size of a character font in accordance with the line width and the number of lines. Color designation is made by three bits, i.e., red (R), green (G), and blue (B). ROP designation indicates the type of logic operation when a character font is written in the VRAM 12, and for example, an operation "store" for overwriting data, an operation "not store" for inverting and setting source data, an operation "superimpose" for writing data into a portion where write data exists and leaving a background of a data "0" portion, and the like, can be designated.

When the CPU 10 enables the DMA transfer controller 11, it sets the control data in the control register through the CPU bus 30 and the control line 31.

The DMA transfer sequence carried out in the apparatus of this embodiment will now be described with reference to FIG. 6.

(1) The CPU 10 stores the origin address of the main storage of a character font to be transferred in the MAR 17.

(2) The CPU 10 designates the RC data corresponding to the required number of lines, for the line control memory 14 as shown, for example, in FIGS. 2 to 4.

(3) The CPU 10 sets data, e.g., a destination address of the VRAM 12, etc., in the control register of the DMA transfer controller 11, and then enables the DMA transfer controller 11.

(4) As shown in FIG. 6, a line control memory readout cycle is initiated. More specifically, before fetching the character font on the main storage, a line strobe signal LSTB is generated, and the RC data is read out from the line control memory 14 in accordance with the content of the line counter 15 during the ON interval of the signal LSTB. The RC data corresponding to a line in question is latched in the RC latch circuit 18 in response to the trailing edge of the line strobe signal LSTB.

(5) A character strobe signal CSTB is sent from the DMA transfer controller 11, thus starting a character font readout cycle. During this cycle, a value designated by the MAR 17 is added to the RC data latched by the RC latch circuit 18, and the sum is used as the address of the main storage to read out a line of a character font. The readout data is latched by the data latch circuit 21 in response to the trailing edge of the signal CSTB.

(6) A VRAM strobe signal VSTB is sent from the DMA transfer controller 11, thus setting a VRAM wire cycle. During this cycle, the data latched in the data latch circuit 21 is written in a predetermined area of the VRAM 12.

(7) When the DMA transfer cycle consisting of the above sequences (4) to (6) is repeatedly executed in units of lines a number of times, corresponding to the designated number of lines, the DMA transfer sequence is completed. The character font on the main storage is expanded on the VRAM 12 in a predetermined pattern format and is stored therein.

As described above, the number of lines of the character font can be changed by the line control memory 14, and the RC data is programmable. Therefore, 16-dot, 24-dot, and 32-dot character fonts can be transferred. The character fonts can be allocated on the main storage or a kanji ROM, multi font control can be easily realized, and high-speed processing is obtainable.

According to the present invention as described above, multi font control, desired pattern development control, e.g., character vertical elongation control, ruled line connection control, and the like, can be realized in the character font DMA transfer sequence, thereby allowing efficient character font transfer.

Although the preferred embodiment of the present invention has been described herein, various changes and modifications may be made within the spirit and scope of the invention.

For example, the present invention is not limited to RC data. Areas for setting other attribute data, e.g., underline, overline, line cursor, and the like, can be provided in the line memory 14, and character font transfer data can be processed by the DMA transfer controller 11 in accordance with the attribute data. The display data transfer control apparatus of another embodiment according to the present invention for carrying out the above described function will now be described with reference to FIGS. 7 to 13.

Figure 7:
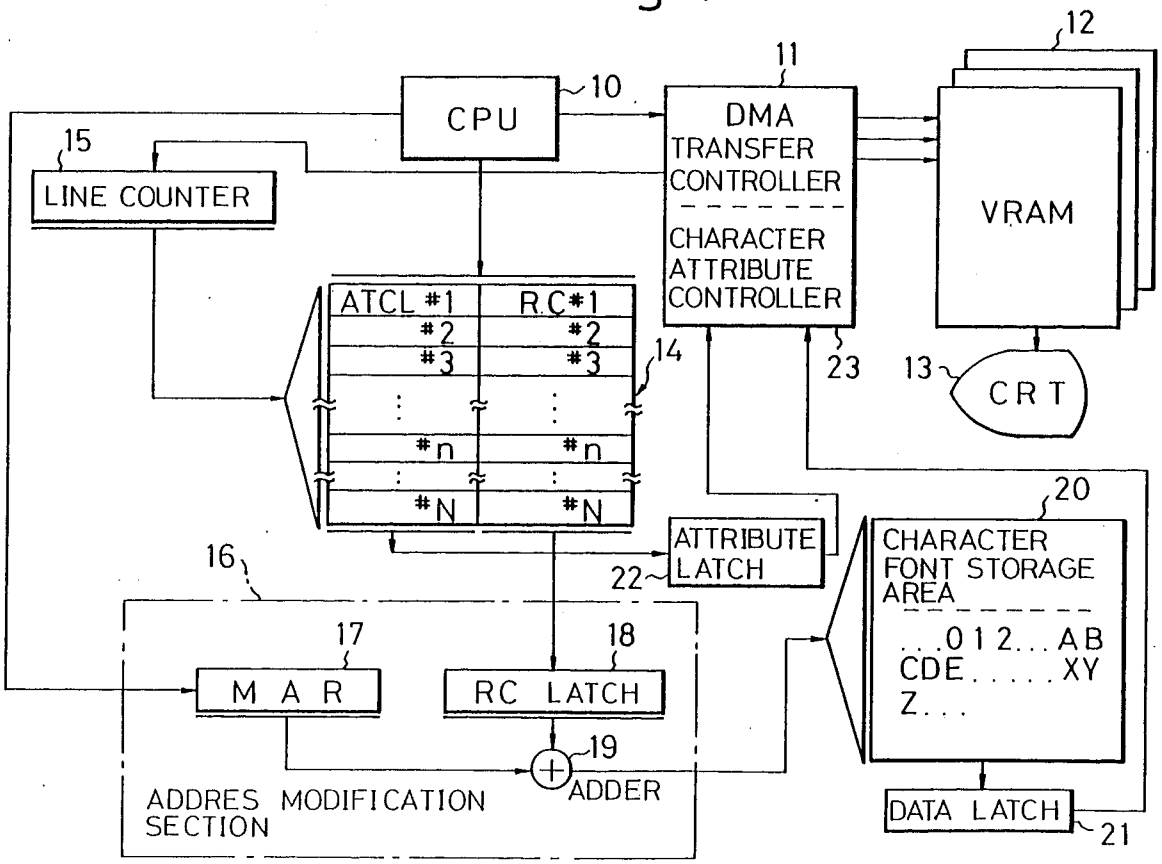
FIG. 7 is a block diagram showing a schematic arrangement of another embodiment according to the present invention.
Figure 11:
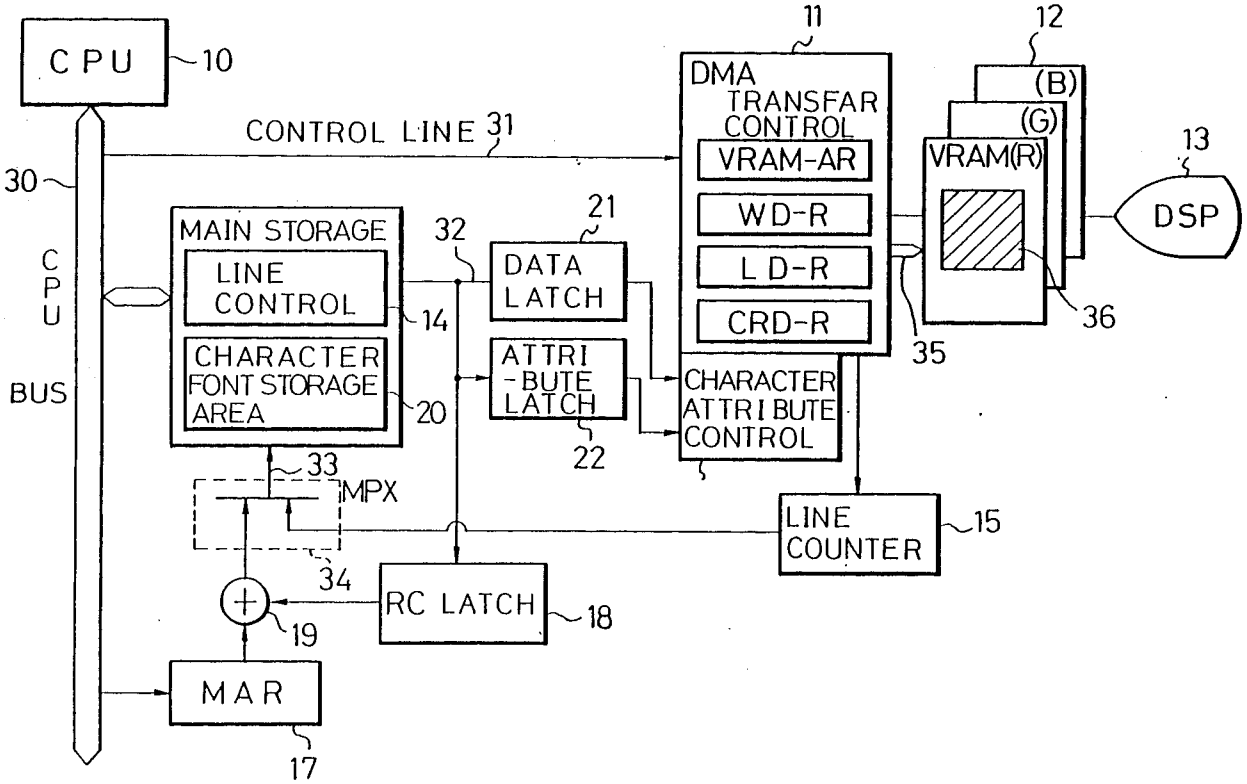
FIG. 11 is a more detailed block diagram of the embodiment shown in FIG. 7.

FIG. 7 is a block diagram showing a schematic arrangement of such an embodiment, and FIG. 11 is a more detailed block diagram of the embodiment shown in FIG. 7. In FIGS. 7 and 11, blocks bearing the same reference numeral as in FIGS. 1 and 5 have the same functions as in FIGS. 1 and 5; with the following differences. A line control memory 14 is a memory arranged, for example, in a predetermined area at a main storage. The line control memory 14 stores character attribute data for processing character font transfer data in units of transfer lines of the character fonts as well as the RC data aforementioned. A memory address register (MAR) 17 is a register for storing a storage address of a character font to be displayed. The memory address register 16 is accessed by the CPU 10. An attribute latch 22 is a circuit for latching character attribute data read out from the line control memory 14. A character attribute controller 23 is a circuit for determining if the data latched by the data latch 21 is to be transferred or data is to be transferred after attribute processing according to the attribute data latched by the attribute latch 22 and for controlling character attribute control in a DMA transfer sequence.

Figure 8:
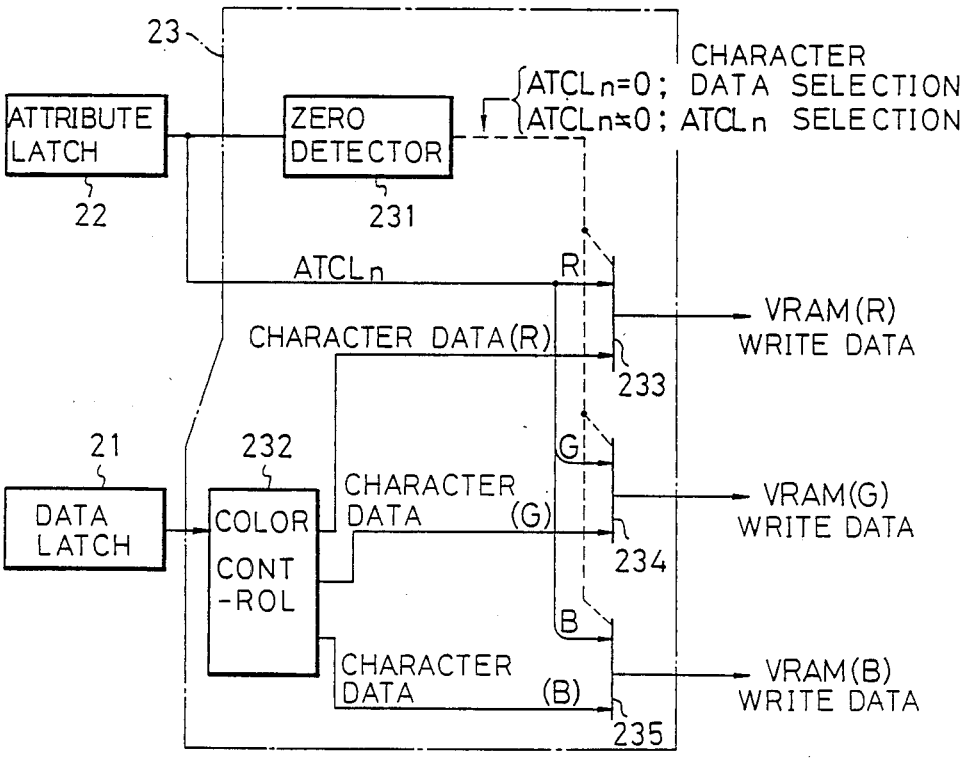
FIG. 8 is a block diagram showing a character attribute control circuit shown in FIG. 7 as the embodiment of the present invention.

The character attribute controller 23 in FIG. 7 or 11 is arranged in detail, as shown in FIG. 8. Referring to FIG. 8, reference numeral 231 denotes a zero detector for checking whether character attribute data ATCLn latched by the attribute latch 22 is all-zero data; 232, a character color control circuit for controlling a display character color; and 233 to 235, multiplexers, respectively.

The basic operation of the display data transfer control apparatus having the above arrangement according to the present invention will be described below with respect to the character attribute control.

The CPU 10 presets attributes data such as an underline, an overline, and the like in the line control memory 14, and sets a origin address of the character font to be displayed in the memory address register 16. When the CPU 10 causes the DMA transfer controller 11 to start, the count of the counter 15 is updated by the DMA transfer controller 11 and attribute data is read out from the line control memory 14. The character attribute processing is performed by the character attribute controller 23. The attribute data can be used to specify, e.g., colors of an underline, an overline, and the like. The attribute is arbitrarily set in the line control memory 14. Data processing by desired character attributes can be realized in the DMA transfer sequence for the VRAM 12.

The display character attribute controller performs processing of character attributes such as an underline and an overline in the DMA transfer sequence.

Figures 9, 10:
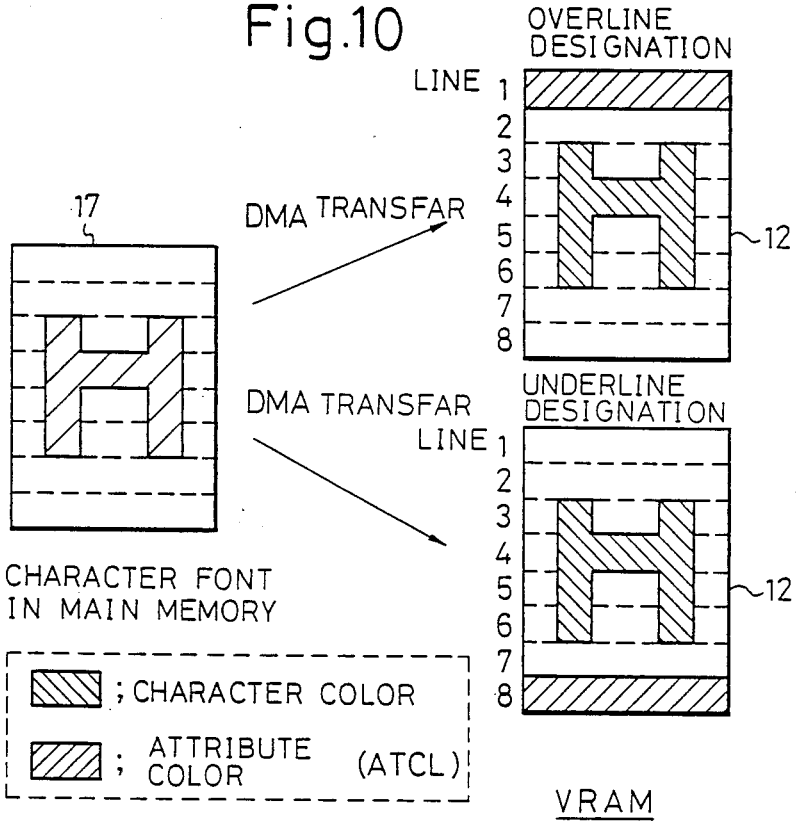
FIG. 9 is a table for explaining data set in a line control memory as an embodiment of the present invention.
FIG. 10 is a view for explaining a character attribute control operation as an embodiment of the present invention.
Figure 12:
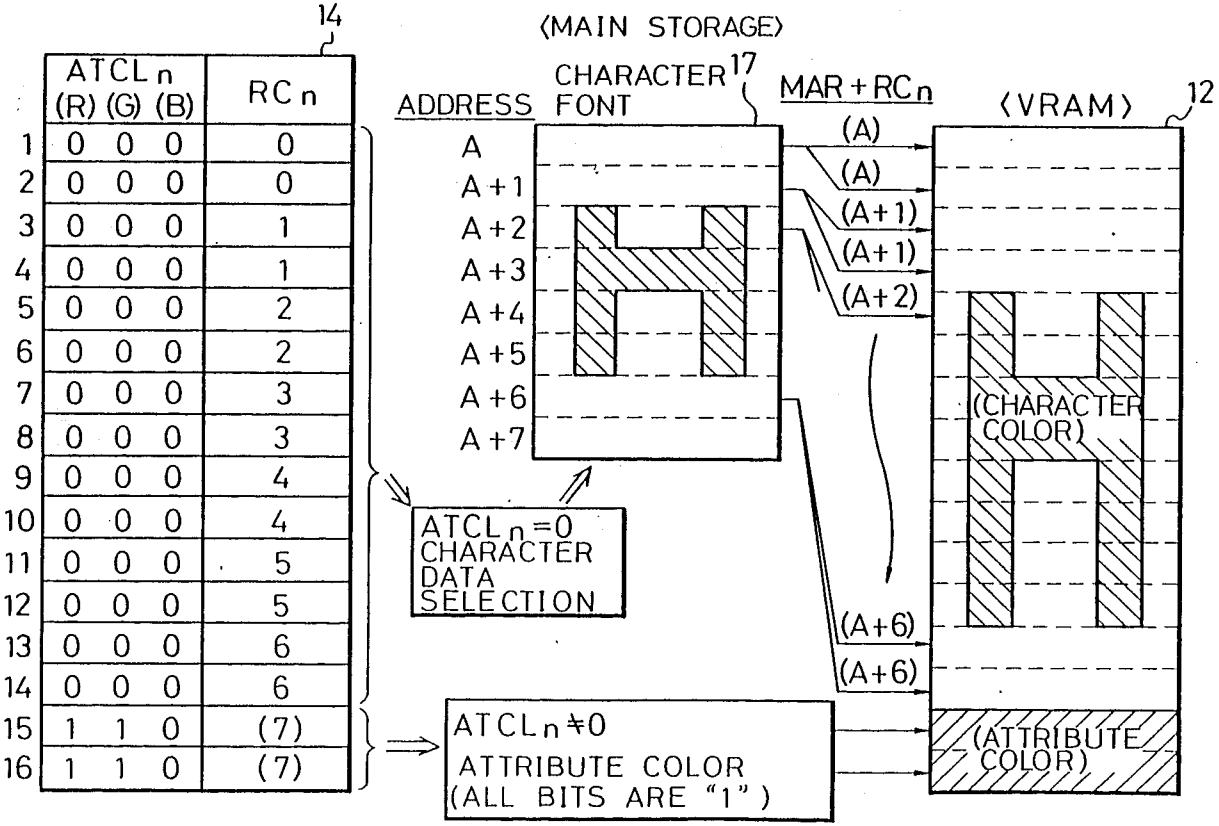
FIG. 12 is a view for explaining character attribute control accompanying vertical elongation control as an embodiment of the present invention.
Figures 13A, 13B, 13C, 13D, 13E, 13F, 13G, 13H, 13I:
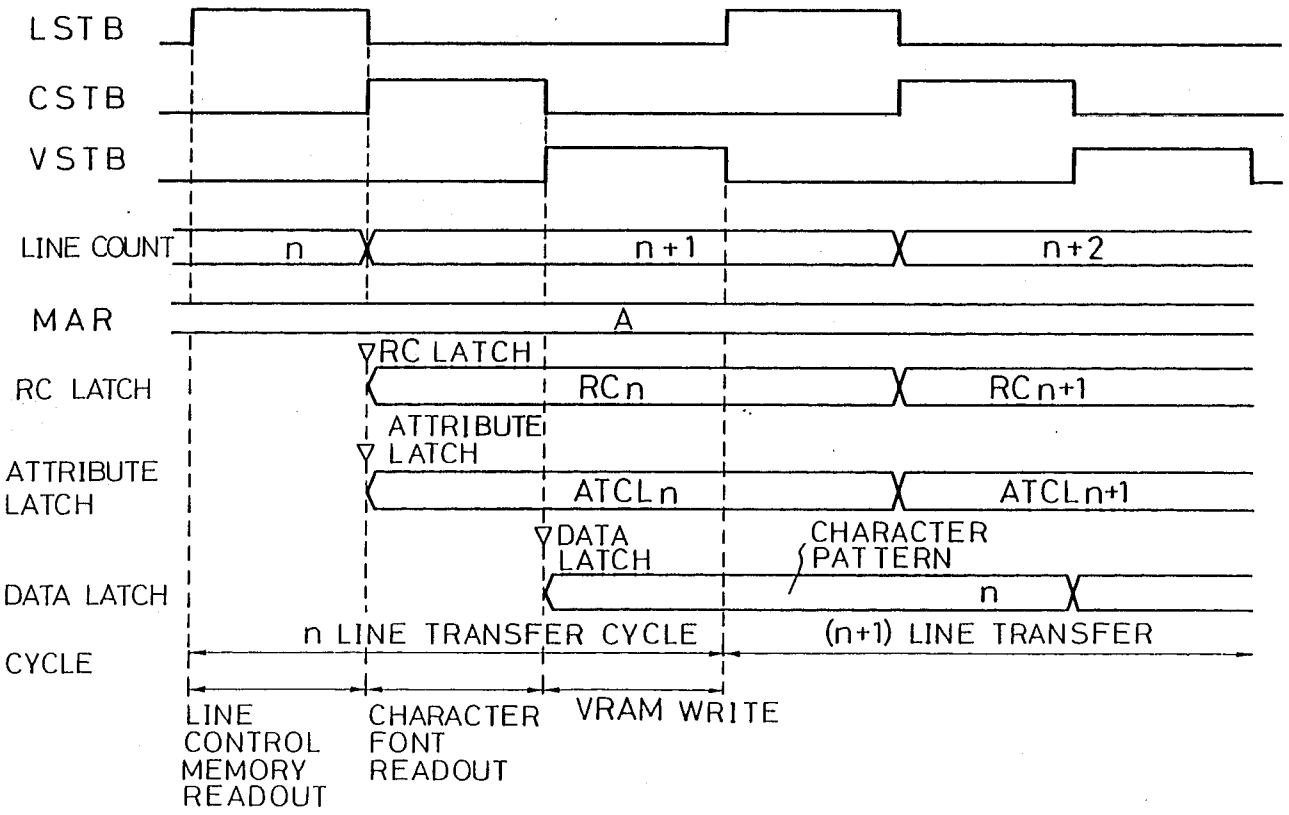
FIG. 13 is a timing chart showing a character font DMA transfer sequence according to the embodiment of the present invention.

The preferred embodiment of the present invention will be described in detail with reference to the accompanying drawings. FIG. 9 is a view for explaining data set in the line control memory, FIG. 10 is a view for explaining the character attribute control operation, FIG. 12 is a view for explaining character attribute control accompanying vertical elongation control, and FIG. 13 is a timing chart for explaining the character font DMA transfer sequence according to the embodiment of the present invention.

In this embodiment, the character and the attribute such as an underline can be displayed in a maximum of eight colors. The character attribute data ATCLn comprises 3 bits and represents a color of an attribute such as an underline in correspondence with color factors R, G, and B. A character font read out from the character font storage area 20 is converted to color factor R, G, and B data by the character color controller 232. The zero detector 231 determines whether the three bits of the attribute data ATCLn are all zeros in units of transfer lines. If the three bits are determined to be all zeros, character data (R), (G), and (B) are respectively selected by the multiplexers 233 and 235 and are transferred to the VRAM 12. If the three bits are determined not to be all zeros, the transfer line is set as "1" in the VRAM 12 regardless of the character data according to the color factors specified by the ATCLn.

According to the above control, an overline, an underline, and the like can be designated, as will be described below. In this embodiment, for example, a standard character font is constituted by 8-line dots. If a magenta overline (OL) is specified, data is set in the line control memory 14, as shown in FIG. 9. In this case, the attribute data ATCL1 for the first line is given as "101" so that "1"s are respectively written in the R and B planes of the VRAM 12. Therefore, an overline is drawn, as shown in FIG. 10. In the second line and the subsequent lines, ATCL2 to ATCL8 are all zeros so that the character fonts in the main storage can be written in designated colors in the VRAM 12.

Similarly, in order to designate an underline, "101" is written at the ATCL8 position, as shown in FIG. 9. Thereby, "1" is written with the designated attribute color on only the eighth line designated as the underline in the VRAM 12, as shown in FIG. 10.

Although omitted from the accompanying drawings, attribute data can be designated for a plurality of lines, and whereby can be used as a line cursor. It is also possible to highlight a portion with a predetermined color. Since an attribute color can be specified as the character attribute data ATCLn, the colors of an overline, an underline, and the like can be designated independently of the colors of character fonts.

In the above embodiment, the ATCLn comprises 3 bits but it may comprise four or more bits to achieve a multicolor display.

FIG. 12 shows an example of line cursor character attribute control and a double vertical elongation control as one embodiment of the present invention.

The origin address of the character font is address A in the character font storage area 20 in the main storage and comprises eight lines. 16-line data is set in the line control memory 14 for vertical elongation control. In this embodiment, ATCL15 and ATCL16 are "110"s, respectively. Yellow is designated as the attribute color. The bits of the attribute data for lines 1 to 14 are all zeros. The lines corresponding to this portion indicate that character font data is to be selected. As for RC data, "0" are respectively set in lines 1 and 2; "1"s are respectively set in lines 3 and 4, "2"s are respectively set in lines 5 and 6, and so on. Thus, the same number is assigned for each two consecutive lines. Since the RC data is used as an index value for determining addresses of lines to be transferred from the character font, each line of the character font is transferred twice, as shown in FIG. 12. Character attribute control and vertical elongation control are simultaneously performed in the DMA transfer sequence.

By setting RC data signals having the same value in the line control memory 14 in the same manner as described above, vertical ruled line extension and connection control can be achieved. In addition, since the horizontal width and the number of lines are variable, so-called multifont control can also be performed.

The RC latch 18 in FIG. 11 is a circuit for latching RC data read out from the line control memory 14. The adder 19 adds the content of the memory address register 17 and the latched RC data to generate a transfer line address. The address multiplexer 34 switches between a read operation of the line control memory 14 and a read operation of the character font storage area 20.

The DMA transfer sequence in the apparatus of the embodiment shown in FIG. 11 will be described with reference to FIG. 13.

(1) The CPU 10 stores, in the memory address register 17, the origin address of the main storage which corresponds to the storage area of the character font to be transferred.

(2) The character attribute data ATCLn and the RC data RCn for a required number of lines are set in the line control memory 14.

(3) The CPU 10 sets data such as the transfer destination address of the VRAM 12 in the control register in the DMA transfer controller 11 at need, and causes the DMA transfer controller 11 to start.

(4) As shown in FIG. 13, the line control memory read cycle is started. That is, a line strobe signal LSTB is sent out before the character font is read from the main storage. Meanwhile, the attribute data and the RC data are read out from the line control memory 14 in response to the count of the line counter 15. At the trailing edge of the LSTB, the attribute data for the corresponding line is latched by the attribute latch 22 and the RC data is latched by the RC latch 18.

(5) A character strobe signal CSTB is then sent out from the DMA transfer controller 11 to initiate the character font read cycle. In this cycle, the value designated by the memory address register 17 is added to the RC data latched by the RC latch 18. A sum is used as a main storage address to read out one-line portion of the character font. The readout data is latched by the data latch 21 at the trailing edge of the CSTB.

(6) A VRAM strobe signal VSTB is then output from the DMA transfer controller 11 to initiate the VRAM read cycle. In this cycle the character attribute controller 23 discriminates the attribute data latched by the attribute latch 22. The character pattern latched by the data latch 21 is processed according to the attribute data. The processed data is stored in a predetermined area in the VRAM 12.

(7) The DMA transfer cycle comprising the sequences (4) to (6) is repeated for each line. When the cycles are repeated for the designated number of lines, the DMA transfer sequence is completed. Attribute processing of the character font in the main storage is performed so that the display data can be expanded in the VRAM 12 in a predetermined pattern.

As described above, the character attribute data in correspondence with the line of the character font to be transferred and the RC data for designating the line to be transferred are properly set in the line control memory 14. By only these operations, desired attribute processing and various pattern expansions can be performed at a high speed in the DMA transfer sequence.

According to the present invention as described above, the processing of attributes such as an underline and an overline, as well as the character elongation processing and the ruled line connection processing, etc., can be performed for the character fonts stored in the main storage, a kanji ROM, or the like, and the processed character font can be transferred to the VRAM in the DMA transfer sequence of the character font, thereby improving the efficiency of character processing. For example, attribute color data can be used as the attribute data to display attribute patterns in colors different from those of characters.

We claim:

1. A display data transfer control apparatus comprising:

video memory means for storing data of an image to be displayed on a display screen;

font memory means for storing character font data corresponding to respective characters, the data for each character including a number of transfer lines;

DMA transfer control means for transferring each transfer line of the character font data from the font memory means to the video memory means by means of DMA;

line control memory means for storing raster count data, corresponding to a respective one of the transfer lines to be transferred, for modifying an address of the font memory means storing the character font data; and address modification means for sequentially reading the raster count data from the line control memory means for each transfer line and for modifying an address of the character font data on the basis of the read raster count data during the DMA transfer of each transfer line of the character font data to generate a DMA transfer source address for the font memory means wherein the DMA transfer control means controls the reading out of the raster count data from the line control memory means and the generation of the DMA transfer source address by means of the address modification means, so as to transfer the character font read out from the font memory means to the video memory means.

2. A display data transfer control apparatus set forth in claim 1, wherein the address modification means comprises:

an address register for storing an origin line address of the data of the character font to be displayed in the font memory; and an adder for adding the content of the address register and the content read out from the line control memory to generate the address-modified transfer source address.

3. A display data transfer control apparatus set forth in claim 2, wherein the raster count data stored in the line control memory means is numerical data increasing one by one, whereby a normal display control of the character is performed.

4. A display data transfer control apparatus set forth in claim 2, wherein the raster count data stored in the line control memory means is numerical data increasing one by one in every unit, the unit comprising a plural number of data and the number of the units corresponding to the number of the character font lines, whereby a vertical elongation display control of the character is performed.

5. A display data transfer control apparatus set forth in claim 2, wherein the raster count data stored in the line control memory means is numerical data increasing one by one except at a specific portion corresponding to a medium point of the ruled line the same numeral data is repeated, whereby the vertical ruled line connection display control is performed.

6. A display data transfer control apparatus set forth in claim 1, wherein the font memory and the line control memory are constituted by a single main storage.

7. A display data transfer control apparatus comprising:

video memory means for storing data of an image to be displayed on a display screen;

font memory means for storing character font data corresponding to respective characters, the data for each character including a number of transfer lines;

DMA transfer control means for transferring the character font data from the font memory means to the video memory means by DMA in each transfer line;

line control memory means for storing raster count data and character attribute data, each corresponding to a respective one of the transfer lines to be transferred, the raster count data for modifying an address of the font memory means storing the character font data;

address modification means for sequentially reading the raster count data from the line control memory means for each transfer line and for modifying an address of the character font data on the basis of the read raster count data to generate a DMA transfer source address for the font memory means; and character attribute control means for processing transfer data of the character font during the DMA transfer of the character font data on the basis of the character attribute data read out sequentially from the line control memory means for each transfer wherein the DMA transfer control means controls the reading out of the raster count data and the character attribute data from the line control memory means, the generation of the DMA transfer source address by means of the address modification means, and the character attribute processing by means of the character attribute control means, so as to transfer the character font read out from the font memory means while performing the character attribute processing to the video memory.

8. A display data transfer control apparatus set forth in claim 7, wherein the character attribute data is constituted of color data of red, green, and blue, each provided for each line of the character font.

9. A display data transfer control apparatus set forth in claim 8, wherein the character attribute control means comprises:

a zero detector for checking whether character attribute data is all-zero data; and a selection circuit for operating so that when the all-zero data is detected by the zero detector the character font data read out from the font memory means is selected to be transferred to the video memory, and on the other hand, when the all-zero is not detected by the zero detector a pattern according to the character attribute data is selected to be transferred to the video memory means.

10. A display data transfer control apparatus set forth in claim 9, wherein the pattern according to the character attribute data is an under line with respect to the character, having the color determined by the character attribute data.

11. A display data transfer control apparatus set forth in claim 9, wherein the pattern according to the character attribute data is an over line with respect to the character, having the color determined by the character attribute data.

* * * * *

UNITED STATES PATENT AND TRADEMARK OFFICE

CERTIFICATE OF CORRECTION

PATENT NO. : 4,849,747

DATED : July 18, 1989

INVENTOR(S) : Shinji Ogawa et al.

It is certified that error appears in the above-identified patent and that said Letters Patent is hereby corrected as shown below:

Col. 10, line 21, after "memory" insert --means--;

line 44, after "memory" insert --means--;

line 45, after "memory" insert --means--;

line 45, "storage." should be --storage means.--.

Signed and Sealed this

Fifteenth Day of May, 1990

*Attest:*

HARRY F. MANBECK, JR.

*Attesting Officer*

*Commissioner of Patents and Trademarks*